US010731309B2

(12) United States Patent
Adams

(10) Patent No.: US 10,731,309 B2
(45) Date of Patent: Aug. 4, 2020

(54) RESERVOIR BAG

(71) Applicant: Beau G. Adams, Louisville, KY (US)

(72) Inventor: Beau G. Adams, Louisville, KY (US)

( * ) Notice: Subject to any disclaimer, the term of this patent is extended or adjusted under 35 U.S.C. 154(b) by 0 days.

(21) Appl. No.: 16/601,933

(22) Filed: Oct. 15, 2019

(65) Prior Publication Data

US 2020/0123725 A1 Apr. 23, 2020

Related U.S. Application Data

(60) Provisional application No. 62/746,915, filed on Oct. 17, 2018.

(51) Int. Cl.

| | |
|---|---|
| ***E02B 11/00*** | (2006.01) |
| ***B65D 88/16*** | (2006.01) |
| ***E02B 3/10*** | (2006.01) |

(52) U.S. Cl.

CPC ..... *E02B 11/00* (2013.01); *B65D 88/1625* (2013.01); *B65D 88/1656* (2013.01); *E02B 3/108* (2013.01); *B65D 2588/167* (2013.01)

(58) Field of Classification Search

CPC ..... E02B 11/00; E02D 3/108; B65D 88/1625; B65D 88/1656; B65D 2588/167

See application file for complete search history.

(56) References Cited

U.S. PATENT DOCUMENTS

| | | | | |
|---|---|---|---|---|
| 1,406,068 A | | 2/1922 | Padgett | |
| 2,014,116 A | * | 9/1935 | Powers | E02B 3/06 405/23 |
| 4,655,637 A | * | 4/1987 | Vignocchi | E02B 3/12 405/17 |
| 5,015,123 A | | 5/1991 | Houck et al. | |
| 5,051,028 A | | 9/1991 | Houck et al. | |
| 5,154,543 A | | 10/1992 | Houck et al. | |
| 5,176,468 A | * | 1/1993 | Poole | E02B 3/04 405/111 |
| 5,378,357 A | | 1/1995 | Houck et al. | |
| 5,535,499 A | | 7/1996 | Houck et al. | |
| 5,636,938 A | * | 6/1997 | Ragazzo | E02B 3/127 405/15 |
| 6,368,017 B2 | * | 4/2002 | Black | E02D 29/0208 210/170.03 |
| 6,648,549 B1 | * | 11/2003 | Urriola | E02B 11/005 405/39 |
| 6,779,946 B1 | * | 8/2004 | Urriola | E01C 9/004 405/43 |
| 7,056,058 B2 | | 6/2006 | Urriola et al. | |
| 7,670,082 B2 | * | 3/2010 | Olsta | E02D 29/0208 405/129.75 |
| 7,794,148 B2 | | 9/2010 | Derby et al. | |
| 7,918,996 B1 | | 4/2011 | de Bruijn | |

(Continued)

FOREIGN PATENT DOCUMENTS

JP 2003074061 A 3/2003

*Primary Examiner* — Benjamin F Fiorello
(74) *Attorney, Agent, or Firm* — Middleton Reutlinger

(57) ABSTRACT

A reservoir bag and method of use and implementation is disclosed herein. The reservoir bag may be configured for controlling surface water run-off and may include a plurality of cells with at least two adjacent cells in fluid communication with each other to allow water to communicate between the adjacent cells. To aid in the mobility of water, the bag may include one or more perforated pipes therein to direct flow of water through the cells and to an outlet.

30 Claims, 11 Drawing Sheets

(56) References Cited

U.S. PATENT DOCUMENTS

| | | | | |
|---|---|---|---|---|
| 7,922,421 | B2 | 4/2011 | McGillick, Sr. et al. | |
| 8,672,585 | B2 | 3/2014 | Schnaars, Sr. et al. | |
| 8,678,652 | B1 | 3/2014 | Nattrass | |
| 9,206,574 | B2 * | 12/2015 | Parker | E03F 1/002 |
| 9,481,970 | B2 * | 11/2016 | Scott | E02D 29/0208 |
| 9,611,626 | B2 * | 4/2017 | Pettey | E02D 29/0208 |
| 10,030,337 | B2 * | 7/2018 | Kim | E01C 9/002 |
| 10,246,843 | B1 * | 4/2019 | Adams | E02B 3/108 |
| 10,267,010 | B2 * | 4/2019 | Thomas | E02D 29/0208 |
| 10,285,340 | B2 * | 5/2019 | Manning | E02B 3/14 |
| 2004/0156680 | A1 | 8/2004 | Gibbs | |
| 2007/0154264 | A1 * | 7/2007 | Baruh | E02B 3/108 405/110 |
| 2007/0217866 | A1 * | 9/2007 | Oscar | B65D 88/022 405/36 |
| 2008/0124175 | A1 * | 5/2008 | Riste | E02B 11/00 405/37 |
| 2010/0186642 | A1 * | 7/2010 | Christman | E01F 8/025 109/79 |
| 2012/0207406 | A1 * | 8/2012 | Cavenagh | E02B 3/108 383/38 |
| 2012/0230766 | A1 * | 9/2012 | Schnaars, Sr. | E02B 3/108 405/32 |
| 2013/0071186 | A1 * | 3/2013 | Ekern | E02B 11/00 405/45 |
| 2014/0021144 | A1 | 1/2014 | Lane | |
| 2014/0102581 | A1 | 4/2014 | Adams | |
| 2014/0105684 | A1 | 4/2014 | Allard | |
| 2014/0226918 | A1 | 8/2014 | Adams | |
| 2015/0023733 | A1 | 1/2015 | Schnaars, Sr. et al. | |
| 2017/0096789 | A1 * | 4/2017 | Butler | E02B 3/108 |

* cited by examiner

RESERVOIR BAG

TECHNICAL FIELD

Generally, a reservoir bag is disclosed. More specifically, present embodiments relate to a reservoir bag that temporarily retains water and controls water flow characteristics.

BACKGROUND

Surface water runoff as a result of the development of residential and commercial construction may not absorb directly into the ground and therefore increase the volume of water that is needed to be controlled or redirected. These construction applications may be but is not limited to roadways, parking lots, subdivisions, buildings, etc. Existing systems to control the fluid flow of water may include retention ponds and subterranean conduits. However, retention ponds require large surface area that could be used for other applications and that may not be available after drainage problems arise. Further, subterranean conduits overtime may become clogged or settle due to water leaching into the adjacent ground in which it is buried. With the adjacent soil becoming saturated, over time the conduits may shift within the surrounding soil. This settling of the conduits or structure may disrupt the ground resulting in damage to the surface above such uneven parking lot surfaces or negatively impacting structures nearby. Thus, there is a need in the art for overcoming the issues of existing systems.

SUMMARY

The present disclosure is directed towards methods and apparatuses for a reservoir bag and water flow control. The reservoir bag may be, in various embodiments, a bag that is filled with a loose or granular material such as but not limited to #57 aggregate up to 3 inch aggregate to allow the flow of water between two or more cells around the material, and is sized and/or configured for placement in a fully or partially subterranean environment. The bag may include one or more loading cells configured to receive one or more materials and/or may include a lid that may be opened to allow filling of the bag and closed to secure the material in the one or more loading cells. The material may also surround one or more perforated pipes extending longitudinally within the bag from at least one cell to an adjacent cell in order to expedite the control and flow water.

In various embodiments, the pipes may extend through the entirety of the bag along a lower portion of the cells. Each of the cells may be defined by a plurality of baffles extending between side panels and which form the loading cells. The pipes may be provided with perforations to ease flow of water therein so that the water may be redirected through the loading cells and out of the bag in a controlled manner.

In various embodiments, the pipes may be provided along an upper section of the bag as an overflow pipe. Alternative embodiments include allowing the lower portion of the bag to act as a water channel defined by the through openings below the baffles. These through openings can include pipes as well or allow water to simply flow to a conduit or other outlet pipe. In alternative constructions, overflow piping can be provided along an upper area of the bag to function as overflow conduits.

In various embodiments the bag includes a receiving cell on one end that is configured to receive the other end of the bag so that multiple reservoir bags can be attached together. Such attachment may facilitate transferring of the bags as a group, instead of individually, whether filled or emptied. One or more bags may provide a predetermined volume storage and/or flow rate. To facilitate connection and disconnection of multiple bags, removably attachable mechanisms may be employed to connect a first bag to a second bag so that the bags may be detached and reattached as a user sees fit.

One embodiment of the present invention may provide a temporary storage of surface water run-off to control a volume of water and its subsequent release. One advantage is that the device may be installed in areas that do not have sufficient surface area for retention ponds. The device may store water temporarily and have predetermined fluid flow characteristics depending on the size of the aggregate and the size/volume of the bag for a given application. The device can be used to control the volume of water retained and the flow of water, upstream and/or downstream of the device. For example, outflow of the bag can be time released or slowed down from a deluge of rain so that the downstream storm sewers can have time to recover. Further, water temporally stored or flowing through the device can prevent saturation of the surrounding soil which may result in undesirable surface settling.

It should be appreciated that all combinations of the foregoing concepts and additional concepts discussed in greater detail below provided such concepts are not mutually inconsistent are contemplated as being part of the subject matter disclosed herein. In particular, all combinations of claimed subject matter appearing at the end of this disclosure are contemplated as being part of the subject matter disclosed herein.

BRIEF DESCRIPTION OF THE DRAWINGS

In the drawings, like reference characters generally refer to the same parts throughout the different views. Also, the drawings are not necessarily to scale, and emphasis instead generally placed upon illustrating the principals of the embodiments depicted.

DETAILED DESCRIPTION

Figure 1:
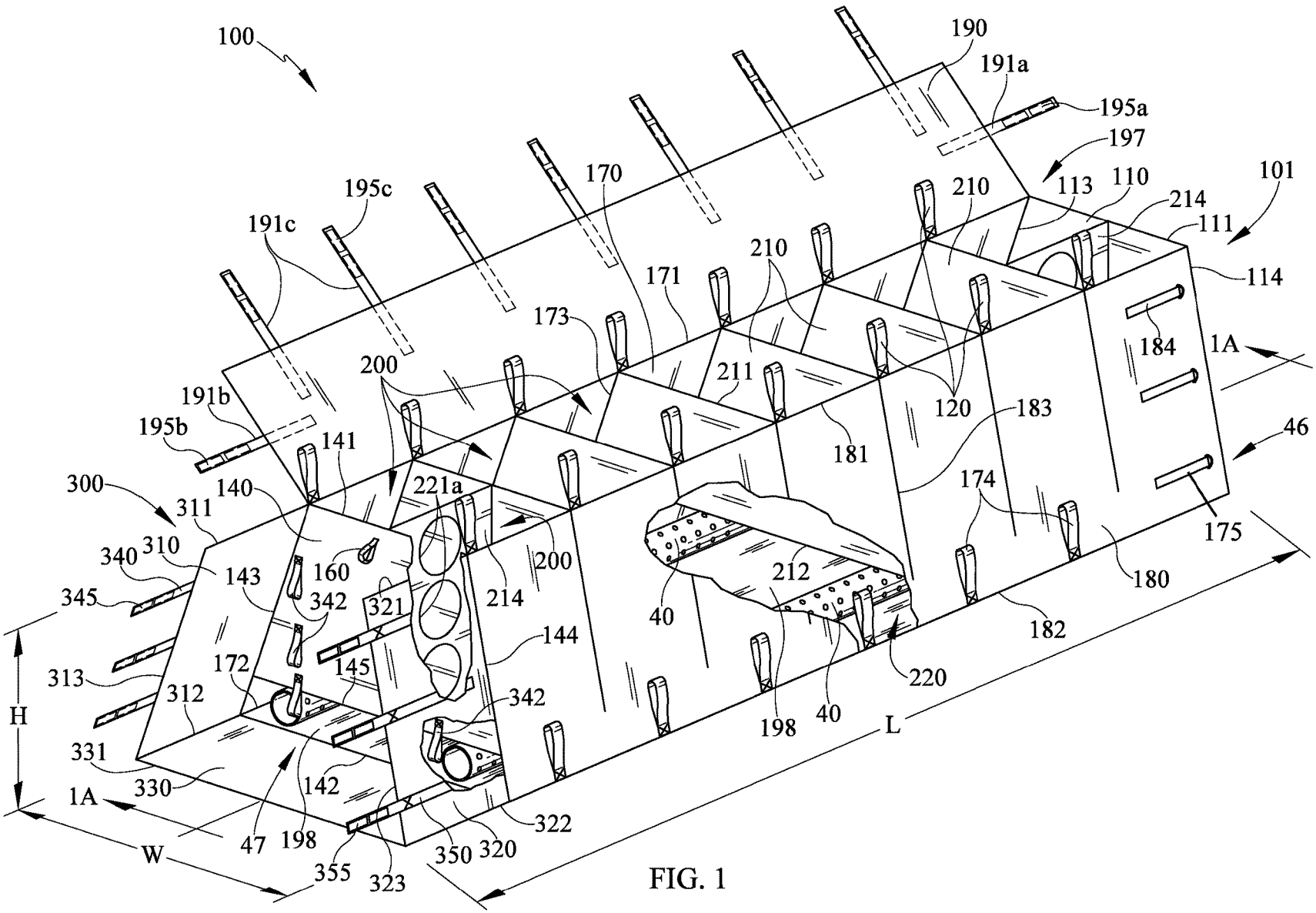
FIG. 1 is a perspective view of an embodiment of a reservoir bag.

It is to be understood that the embodiments are not limited in their application to the details of construction and the arrangement of components set forth in the following description or illustrated in the drawings. Other embodiments are possible and may be practiced or carried out in various ways. Also, it is to be understood that the phraseology and terminology used herein is for the purpose of description and should not be regarded as limiting. The use of "including," "comprising," or "having" and variations thereof herein is meant to encompass the items listed thereafter and equivalents thereof as well as additional items. Unless limited otherwise, the terms "connected" and "coupled" and variations thereof herein are used broadly and encompass direct and indirect connections and couplings. In addition, the terms "connected" and "coupled" and variations thereof are not restricted to physical or mechanical connections or couplings.

Referring to FIGS. 1-7, embodiments of a reservoir bag 100 are depicted. The reservoir bag 100 includes an elongated body that may have a plurality of baffles interconnecting one or more outer peripheral sides of the body to define a number of cells. The elongated bag may be collapsible between a variety positions, for instance from a smaller stored position to an expanded position able to receive material and other structure. Reservoir bag 100, receiving cell 300, lid 190, baffle 210 and/or any portion of either, may be made of any of a variety of materials including, but not limited to, polypropylene, high strength canvas or the like. In one embodiment, the bag may be formed of any material well known in the art, such as but is not limited to woven polypropylene fabric. It may be desirable to incorporate material which is impervious to water and which sufficiently retains the fill material 400 therein. The bag material may be substantially impermeable to allow for the temporary storage of water or allow the water to flow and/or stop within the bag. The tensile strength and puncture strength may conform to ASTM D1682 and ASTM D751. Each of said cells may be filled fully or partially with one or more materials, not all cells have to be of the same materials along the elongated body length, height, and/or width. Alternatively, a cell may be partially or fully empty. The reservoir bag is, in various embodiments, may be filled with a loose or granular material such as but not limited to #57 aggregate up to 3 inch aggregate to allow the flow of water around the material between two or more cells or various lengths, heights, and/or widths of the bag. The material may be a washed aggregate. Further, one or more cells may be partially or fully filled with concrete. For example, one cell may include one or more layers of aggregate and one or more layers of concrete. The variety of aggregate used may adjust the desired flow rate within the bag and volume of water stored. The bag itself may be also sized or shaped to allow a desired volume of water and/or configured for placement in a fully or partially subterranean environment. For example, the reservoir bag may include an open top adjacent ground level or fully covered below the surface of the ground. Also, it should be understood that one or more reservoir bags do not have to be linear in one or more applications, one or more bags may be orientated in, but is not limited to, an arcuate, serpentine, or spiral patterns, or combinations thereof, etc. Moreover, reservoir bag may be formed in a variety of sizes, shapes, constructions, orientations, and quantities depending on the desired use of the bag associated therewith.

As shown in FIGS. 1-7, reservoir bag 100 may include one or more loading cells 200, which collectively may comprise an internal space of reservoir bag 100. If more than one loading cell 200 is included, the loading cells 200 may be separated by partitions or baffles 210. Any or all of loading cells 200 may be filled one or more materials such as aggregate 410 which may allow water to flow through or more specifically between cells. In this way, reservoir bag 100 may be partially or fully filled with aggregate 410 to allow water to enter the bag, be stored, and exit from the bag. One or more reservoir bags 100 combined in parallel or series may control the flow of water entering and leaving the one or more bags. Reservoir bag 100 may have a height H between the bottom panel 198 and top opening 197, a length L in a longitudinal direction from a first end or first end panel 110 to a second end or second end panel 140, and a width W between the sides or side panels 170 and 180. For example, varying the length of reservoir bag 100 by combining bags may correspond to a desired volume of water for a particular application. Alternatively, two or bags in parallel may also support a specific volume desired for an application. It should be understood that varying the height H, width W, and length L of a bag 100 may define a bag for an application with a specific volume and/or flow requirements. The reservoir bags 100 may be reusable or nonreusable. It should also be understood that the reservoir bags 100 or any portions thereof may be collapsible, such as but not is not limited to the body 101, lid 190, and/or receiving cell 300.

Figure 6:
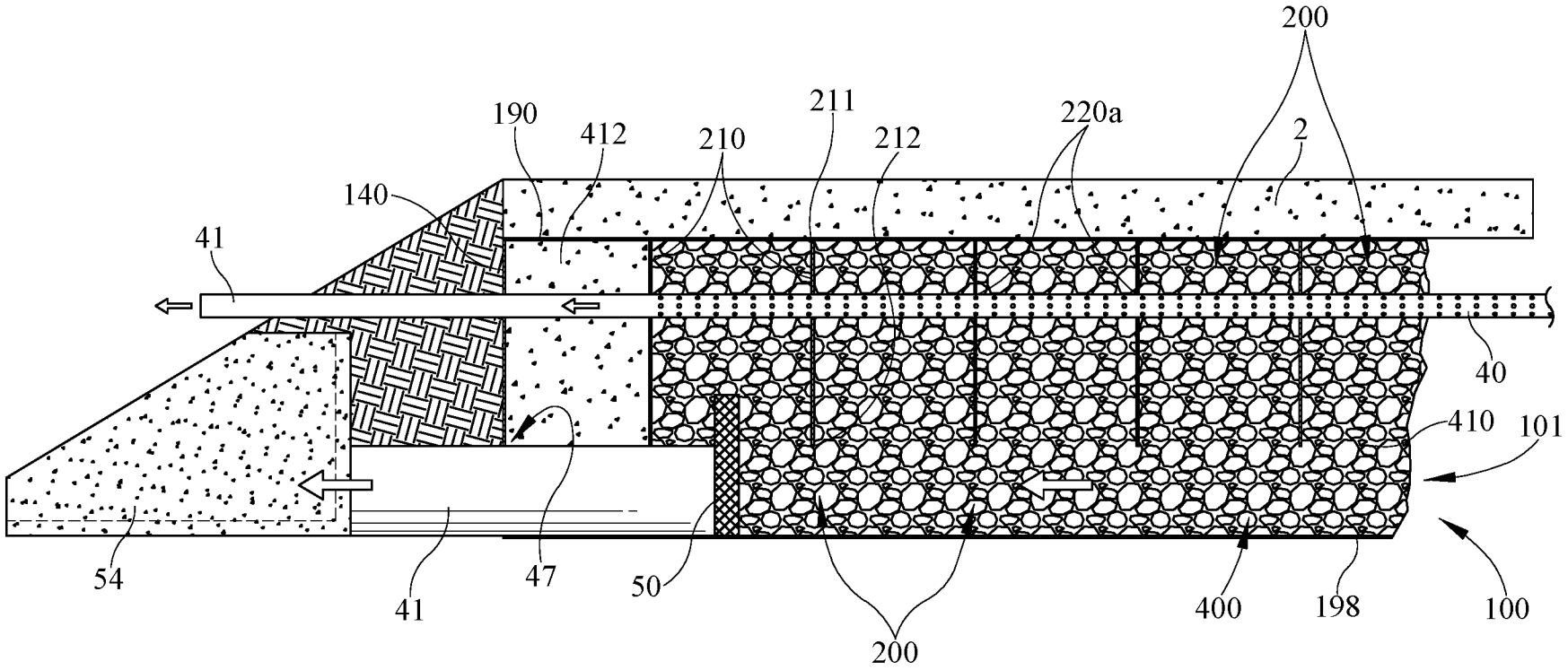
FIG. 6 is a side sectional view of another embodiment of the reservoir bag illustrating a grate upstream of storm pipe extending through the downstream opening of the bag as well as an overflow perforated pipe positioned at a higher elevation within the bag that allows water to bypass the grate if the water level within the bag reaches a predetermined level.
Figure 7:
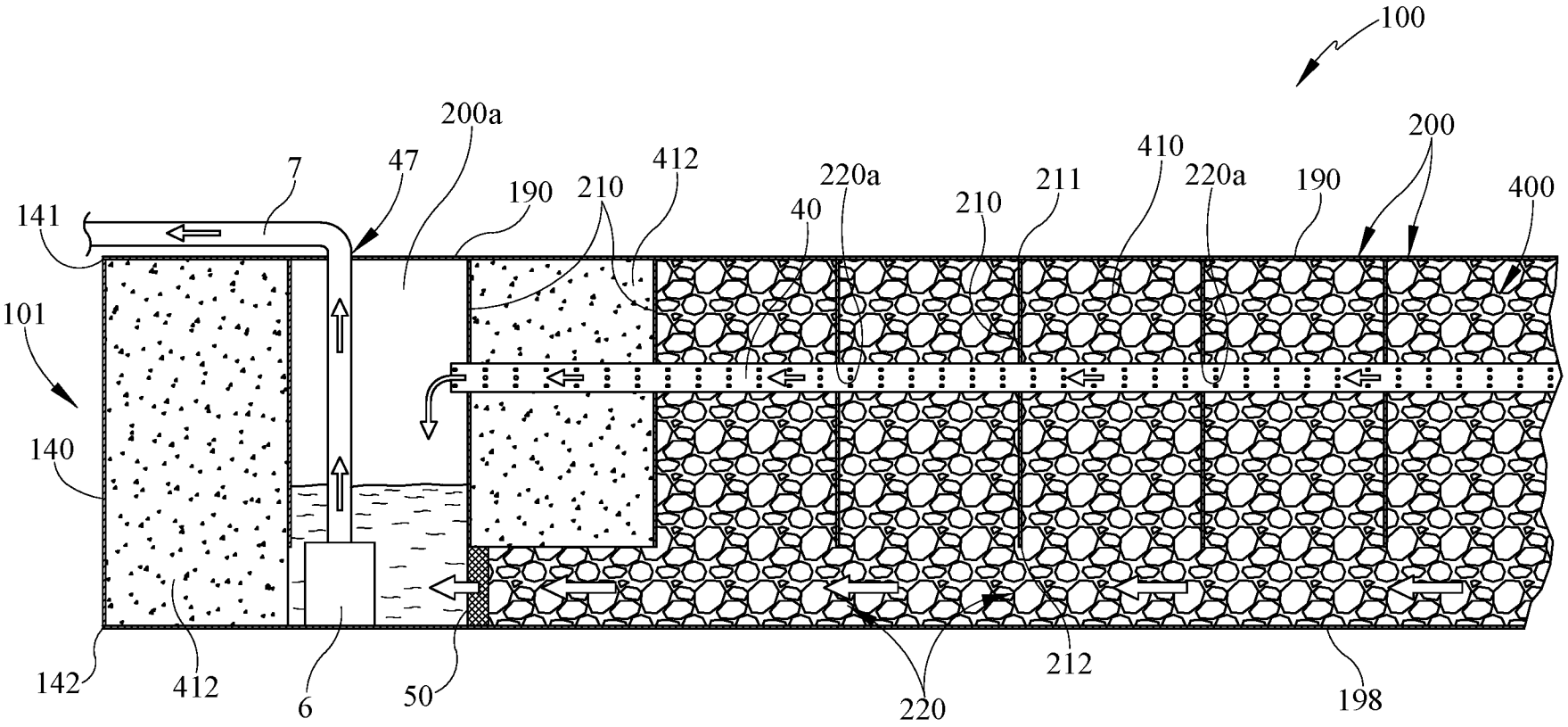
FIG. 7 is a side sectional view of another embodiment of the reservoir bag of FIG. 1 illustrating an open or substantially open cell that may have a pump and/or float to discharge water collected within the open cell at a desired level of accumulation, this one embodiment is also shown with an overflow pipe.

As shown in the figures, one or more baffles 210 may be included in the reservoir bag 100 between the first end panel 110 and the second end panel 140. The elongated body 101 may include a plurality of baffles 210 extending transverse to the longitudinal direction of the elongated body 101. The baffles 210 lateral edges may be connected or sewn to a variety of panels of the bag but is shown in one embodiment as to the opposing sides 170, 180 extending between the first end 110 and the second end 140. Baffle 210 may include a bottom edge 212 and a top edge 211. The top edge 211, or portions thereof, may be adjacent the top opening 197 of the bag 100 and the bottom edge 212, or portions thereof, may be adjacent to the bottom panel 198. The bottom edge 212, or portions thereof, may be spaced away from the bottom panel 198 to define one or more through openings 220 between adjacent cells 200. The through opening 220 of the baffle 210 may also be defined by portions of the bottom panel 198 and/or side panels 110, 140 as shown. In the embodiment shown, the bottom edge 212 of the baffle 210 is spaced about 6 inches from the bottom panel 198 and extends fully between the two opposing sides 170 and 180. The space above the bottom panel 198 allowed by the baffle 210 clearance may allow water to flow at least along the bottom panel 198 or under the bottom edge 212 to create a bag 100 that is fluidly interconnected within and able to drain or flow between cells 200. The through opening 220 may allow flow between one or more inlet openings 46 to one or more outlet openings 47 of the bag 100. The through opening 220 of one or more baffles 210 fluidly connects two or more cells 200 to allow water to flow at least in the longitudinal direction to desired locations within the cell or bag and subsequently removed therefrom with reduced impediment by the baffle 210. Additional openings may be included within the baffle 210 itself (shown in FIGS. 6 and 7), or defined by additional panels of the outer periphery. It is to be understood that the through opening 220 may be a variety of shapes, sizes, quantities, constructions, and positions within and/or defined by the baffle and/or other panels and still provide desired flow characteristics of the water or fluid therethrough. For example, baffle 210 may have an upper opening 220*a* positioned over the through opening 220 as shown in the embodiment of FIGS. 6 and 7 receiving a perforated pipe 40 or overflow pipe for overflow.

One or more baffles inhibit flow within the bag such that the baffles are not positioned substantially adjacent to or flush with the bottom panel to allow a fluid flow channel along the bottom panel. The bottom edge 212 of the baffle 210 is not substantially adjacent or does not abut the bottom panel 198. A baffle or bottom edge substantially adjacent to the bottom panel may be pinched shut and/or overlapped with the bottom panel if compressed by aggregate or incomplete expansion of the collapsible bag, thus preventing water flow. Since the baffle does not extend to or is not substantially adjacent to the bottom panel 198, the fluid flow channel defined by the one or more through openings 220 allows water to flow under the bottom edge 212. One or more aggregate 412 may be positioned between the bottom edge 212 and the bottom panel 198. The bottom edge 212 or baffle may be, but is not limited to, about 2 inches to about 8 inches from bottom panel 198, preferably a distance about 6 inches. Depending on the application, to increase the flow of water within the fluid flow channel, one or more perforated pipes 40 may be positioned in the fluid flow channel or between the baffle 210, or more specifically the bottom edge 212, and the bottom panel 198. It is shown in FIGS. 6 and 7, that some embodiments do not use perforated pipes 40 within the fluid flow channel.

While one of the examples described herein depict a perforated pipe 40, many types of drainage devices allowing fluid to flow through the baffles to an exit point may be utilized. For example, instead of a perforated pipe, an unimpeded flow channel may be provided; a defined and formed fluid flow area formed by, for example a concrete or other structural definition which allows fluid to flow therein; a gutter shaped area or any type of defined area that allows fluid to flow into the flow channel from the baffles and be drawn to the fluid exit from the bag. This can include concrete flow channels combined with metal screens or any other combination of structures which define a fluid channel within the bag structure.

Figure 2:
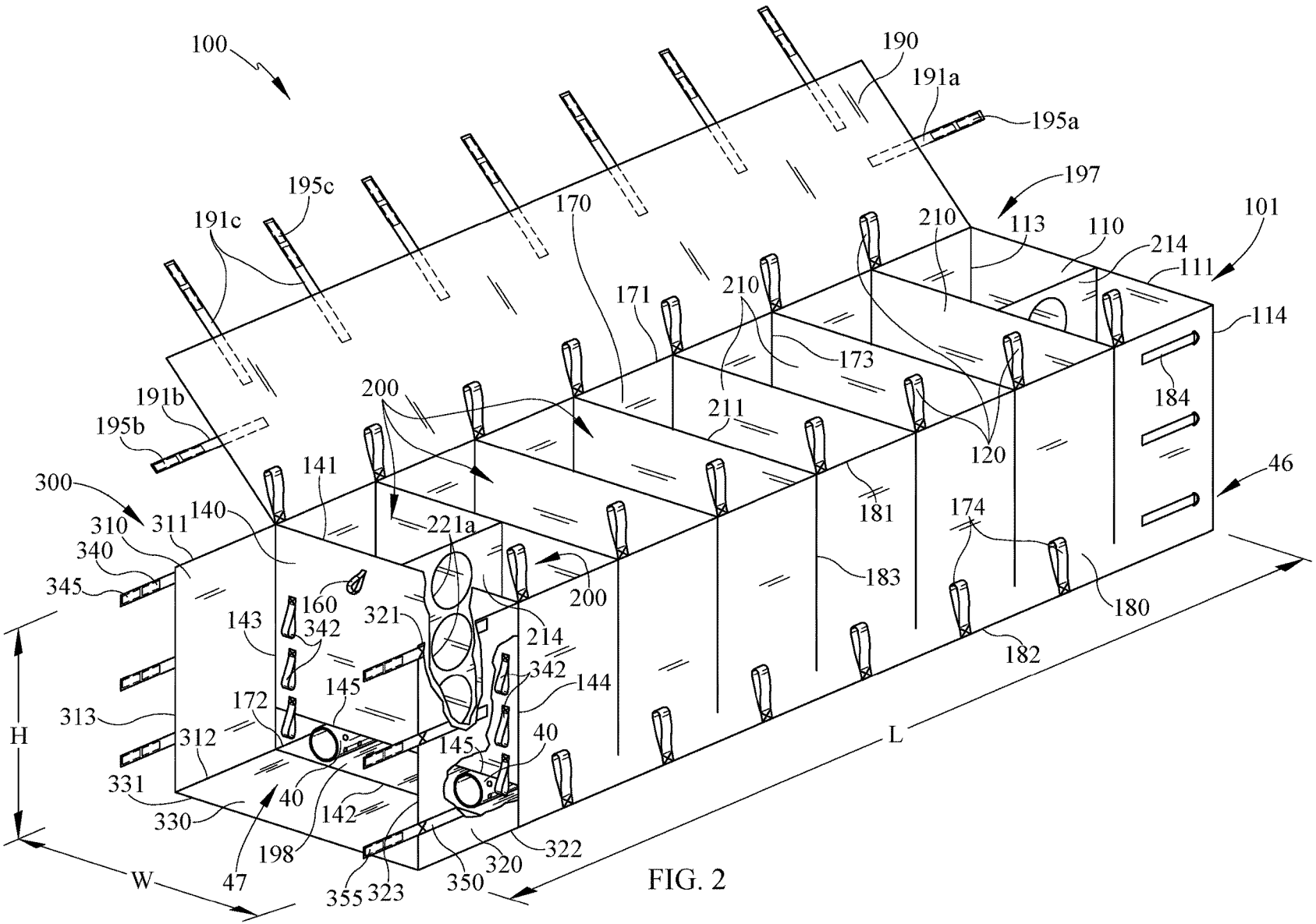
FIG. 2 is a perspective view of another embodiment of the reservoir bag of FIG. 1 with an alternative cross-section.
Figure 3:
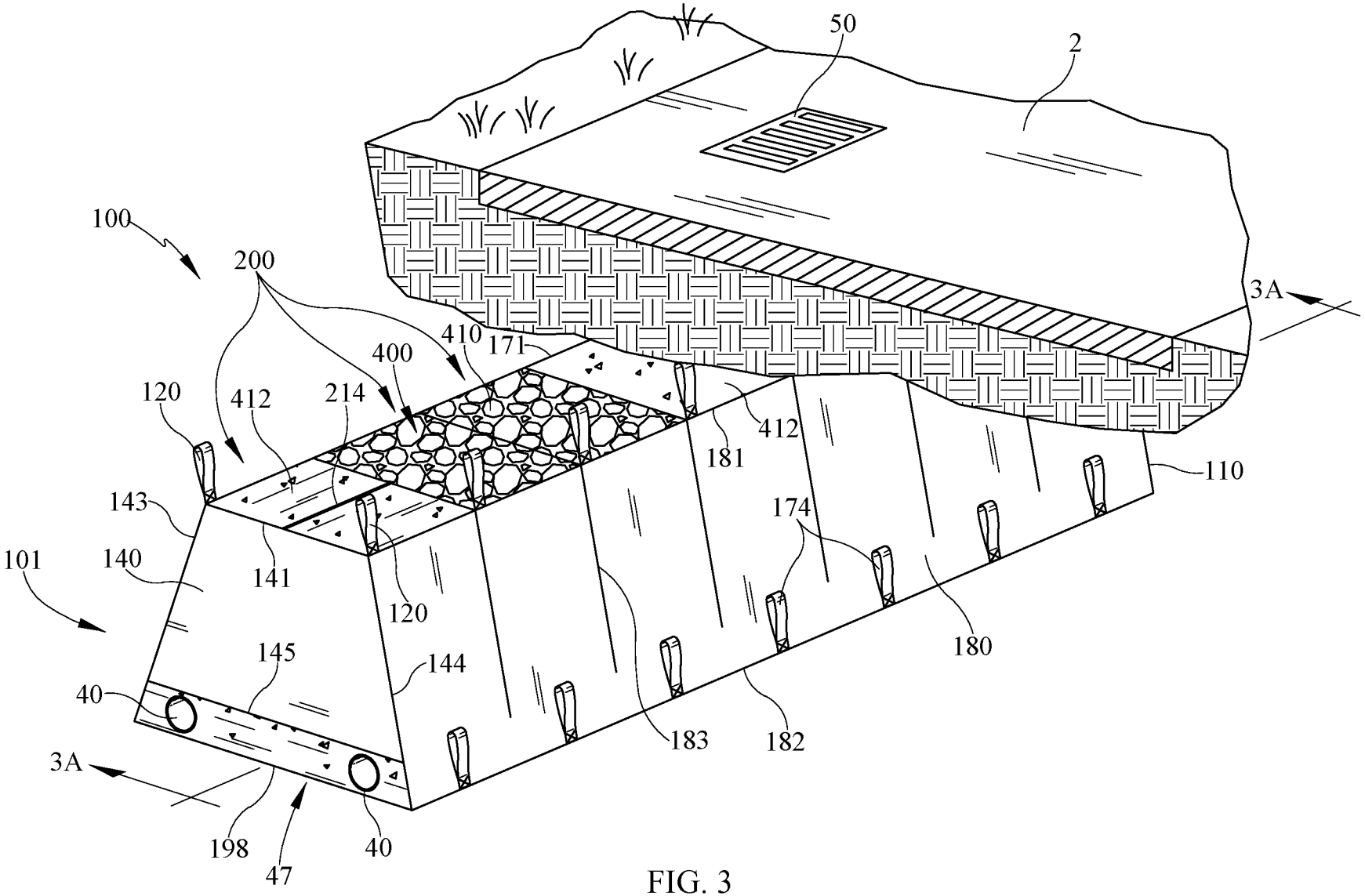
FIG. 3 is a perspective view of another embodiment of the reservoir bag of FIG. 1 without the female connection structure, illustrating the bag in a fully subterranean application with a parking lot or road and with the lid removed for illustrating the variety of materials within one or more cells.

As shown in FIGS. 1-3, one or more second baffles 214 may be included that subdivides one or more cells 200 or the bag 100 in the transverse direction. The one or more cells 200 would be aligned in the transverse direction between the opposing side panels or sides 170 and 180. One or more second baffles 214 may extend substantially along the longitudinal mid-plane of the bag 100 and connect between two adjacent baffles 210. As is shown in one embodiment, the second baffle 214 extends longitudinally between baffle 210 and one or more end panels 110, 140 of the bag 100. In the one embodiment shown, the second baffle 214 is located in the cells located at the opposing ends of the bag 100. The bottom edge 216 of the second baffle 214 may be spaced away from the bottom panel 198 to define one or more second through openings 221. Alternatively, the second baffle 214 may connect to the bottom panel 198. The second through openings 221 may be defined at least partially by the second baffle 214, sides 180, 170, and/or the bottom panel 198. The second baffle 214 may include one or more additional through openings 221*a* within the second baffle. In the embodiment shown for one end of the bag, the bottom edge 216 of the second baffle 214 is spaced about 6 inches from the bottom panel 198 and extends between the second end 140 and the baffle 210. The second baffle 214 may provide for stiffness, or more specifically longitudinal stiffness within the bag or one or more cells. It is to be understood that the baffle 210 and/or second baffle 214 may be a variety of shapes, sizes, quantities, constructions, and positions within the bag and still provide desired flow characteristics of water and support the shape of the bag or one or more cells.

As shown in FIGS. 1-3A, 4A, and 5-7, one or more perforated pipes 40 may be used within the bag 100 to drain or receive water from the surrounding material 400, or more specifically aggregate 410 as shown, to a predetermined location within the bag 100 or exterior of the bag. Although the pipes 40 are shown to be parallel to the longitudinal axis, one or more perforated pipes 40 could extend transversely to the longitudinal axis. As shown in one embodiment in FIGS. 5 and 5A, one or more pipes 40 may drain from the opposing ends 110 and 140 to an interior location of the bag, through a grate 50, in the bottom panel 198, and/or into a storm sewer basin 45. However, the pipes 40 may drain from one end of the bag 100 for a distance or all the way to the opposing end of the bag. Two or more pipes 40 may be connected in series for a length or disconnected for a length. Two or more perforated pipes 40 may be in parallel at substantially the same height or at different elevations within the bag depending on the application. The perforated pipe 40 may be upstream of a downstream opening or outlet 47 of the bag. By varying the diameter, length, and/or the quantity of the perforated pipes, the flow rate out of or within the bag may be predetermined for an application. As is shown in one embodiment, the perforated pipes 40 can be longitudinally positioned within one or more through openings 220, 220*a* of one or more baffles 210 and/or under the bottom edge 212. In addition to one or more perforated pipes 40 within the through openings 220 or alternatively, one or more perforated pipes 40 may be used as an overflow pipe as shown in FIGS. 6 and 7. These overflow pipes 40 may be positioned at a higher elevation than the one or more through openings 220 of the baffles 210, above lower perforated pipes 40, and/or the bottom edge 212 of the baffle 210. The overflow pipe 40 may extend through additional through openings 220*a* above the bottom edge 212 of the baffle 210 or lower through openings 220. Such an overflow pipe 40 may allow for the water volume control within the bag, such that when the water level within the bag 100 reaches a predetermined level or height the overflow pipe 40 increases the amount of water discharged from the bag and/or to another downstream bag. This overflow pipe 40 may reduce the potential for upstream backup of water attempting to enter the bag through the bags upstream opening. Portions of the perforated pipe 40 may be surrounded by one or more materials 400, such as concrete 412 and/or aggregate 410 depending on the application. It is understood, that portions of the pipe or additional pipe do not have to be perforated. For example, one or more pipes downstream and/or upstream to the perforated pipe 40 may be a non-perforated conduit or a storm outlet pipe 41 interior of the bag, exterior of the bag, or extending through the downstream/upstream opening of the bag. It is understood that the perforated pipes 40 do not have to be parallel to the bottom panel 198 of the bag or each other, at least one pipe may be angled relative to the bottom panel 198.

As illustrated, the open-top internal space, base, or loading cell(s) 200 of reservoir bag 100 may substantially be defined on the bottom by bottom panel 198, and/or around the sides by side panels 170, 180 and/or end panels 110, 140. The top of loading cell(s) 200 may be defined by a lid 190 when lid 190 is closed, as discussed in more detail below. Individual loading cells 200, if more than one is included, may be defined on the bottom by bottom panel 198 and on the sides by one or more baffles 210 and/or by any combination of side panels 170, 180 and end panels 110, 140. In some embodiments, first end panel 110 may be connected to: bottom panel 198 at seam 112, first side panel 170 at seam 113, and/or to second side panel 180 at seam 114. First end panel 110 may be defined at the top by top edge 111. In similar fashion, second end panel 140 may be connected to: bottom panel 198 at seam 142, first side panel 170 at seam 143, and/or to second side panel 180 at seam 144. Second end panel 140 may be defined at the top by top edge 141. First side panel 170 may be connected to: bottom panel 198 at seam 172, first end panel 110 at seam 113, and/or to second end panel 140 at seam 143. First side panel 170 may be defined at the top by seam 171, where first side panel 170 attaches or connects to lid 190, if lid 190 is included. If lid 190 is not included, seam 171 may merely form a top edge of first side panel 170. Second side panel 180 may be connected to: bottom panel 198 at seam 182, first end panel 110 at seam 114, and/or to second end panel 140 at seam 144. Second side panel 180 may be defined at the top by a top edge 181. Any or all of baffles 210, if included, may be attached to, connected to, and/or included with any or all of end panels 110, 140, side panels 170, 180, lid 190, and/or bottom panel 198 at, for example in one embodiment, respective seams 173, 183.

Figure 1A:
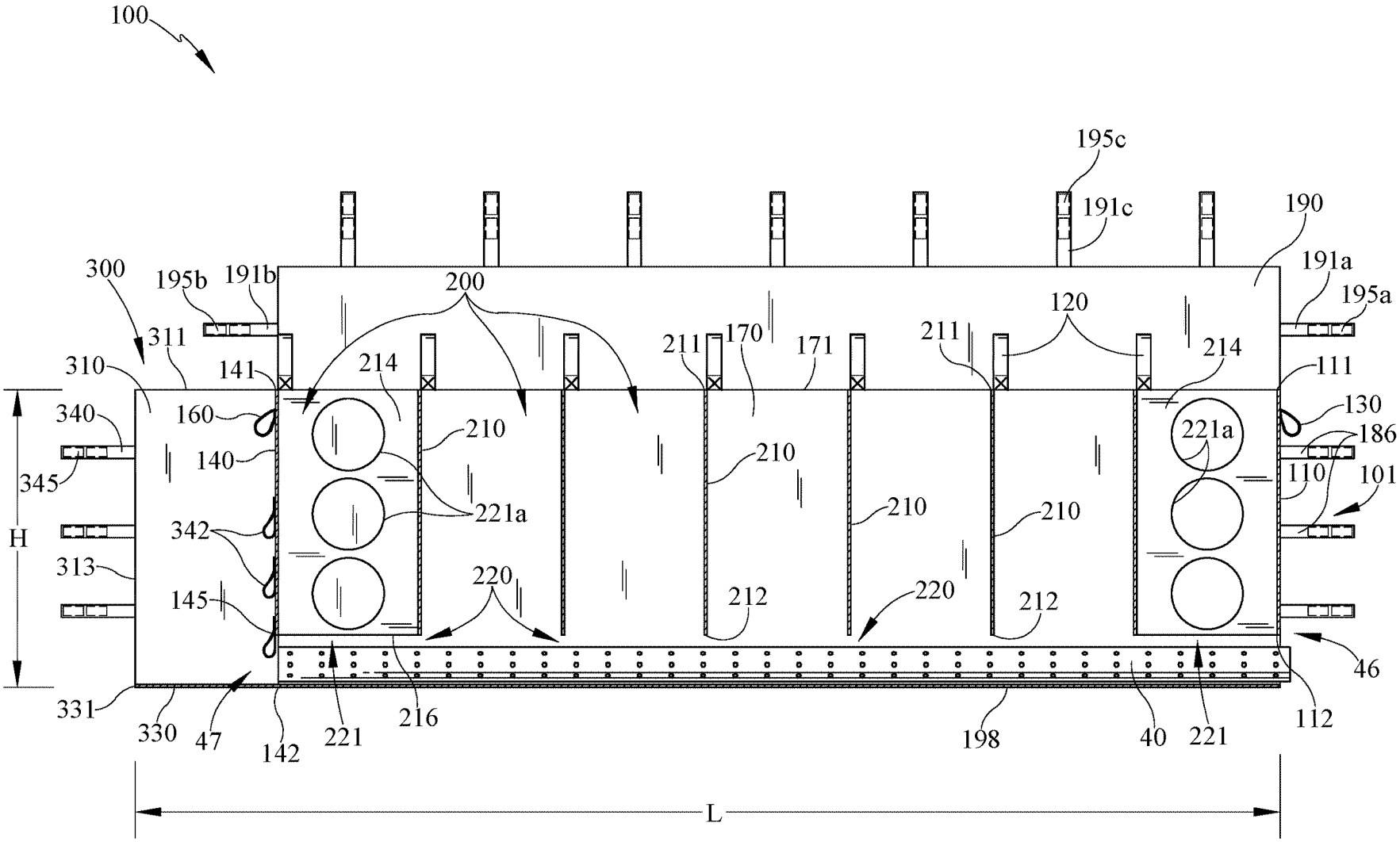
FIG. 1A is a side sectional view of FIG. 1 taken along line 1A-1A.
Figure 3A:
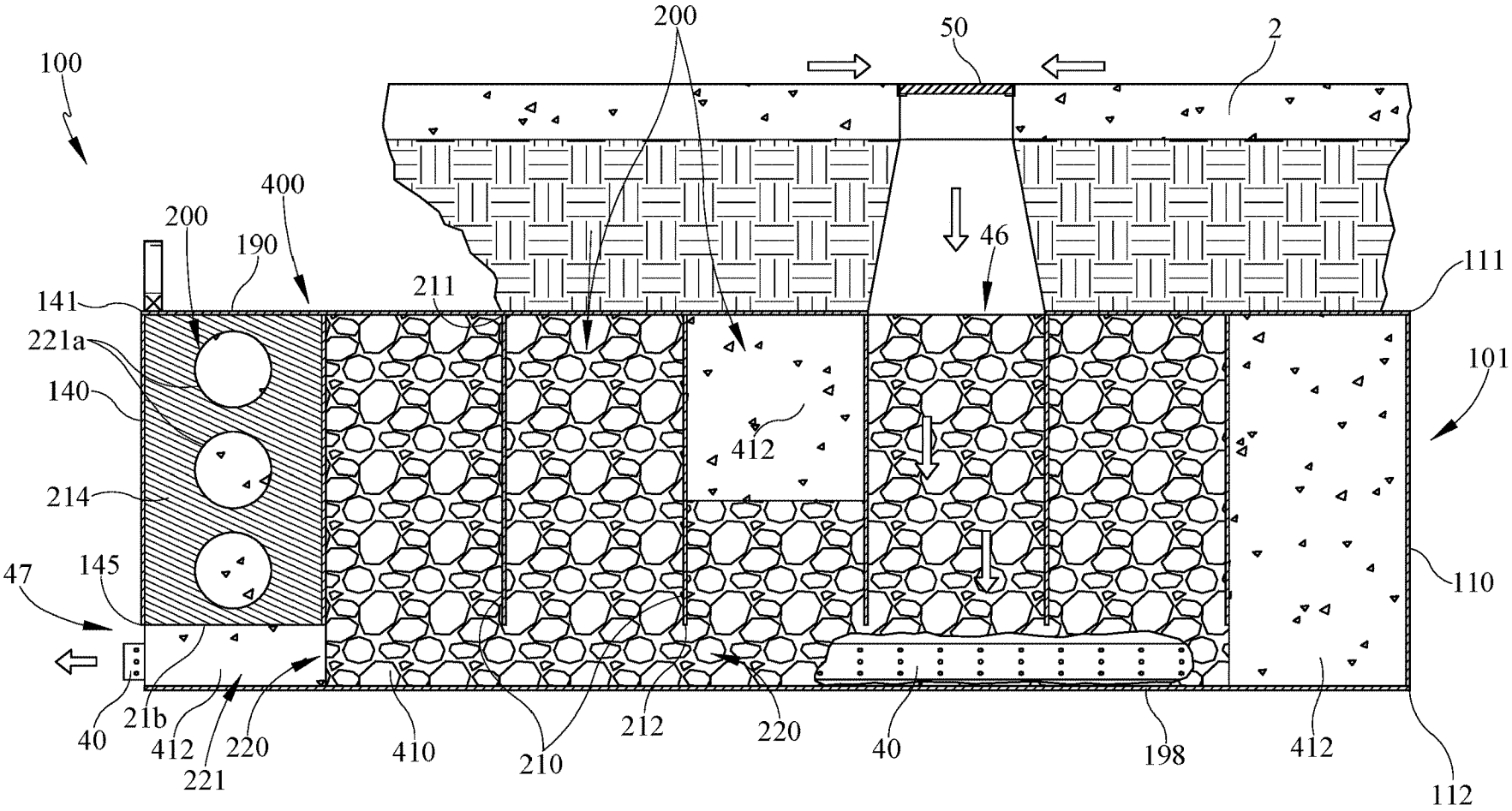
FIG. 3A is a side sectional view of FIG. 3 taken along line 3A-3A.
Figure 4:
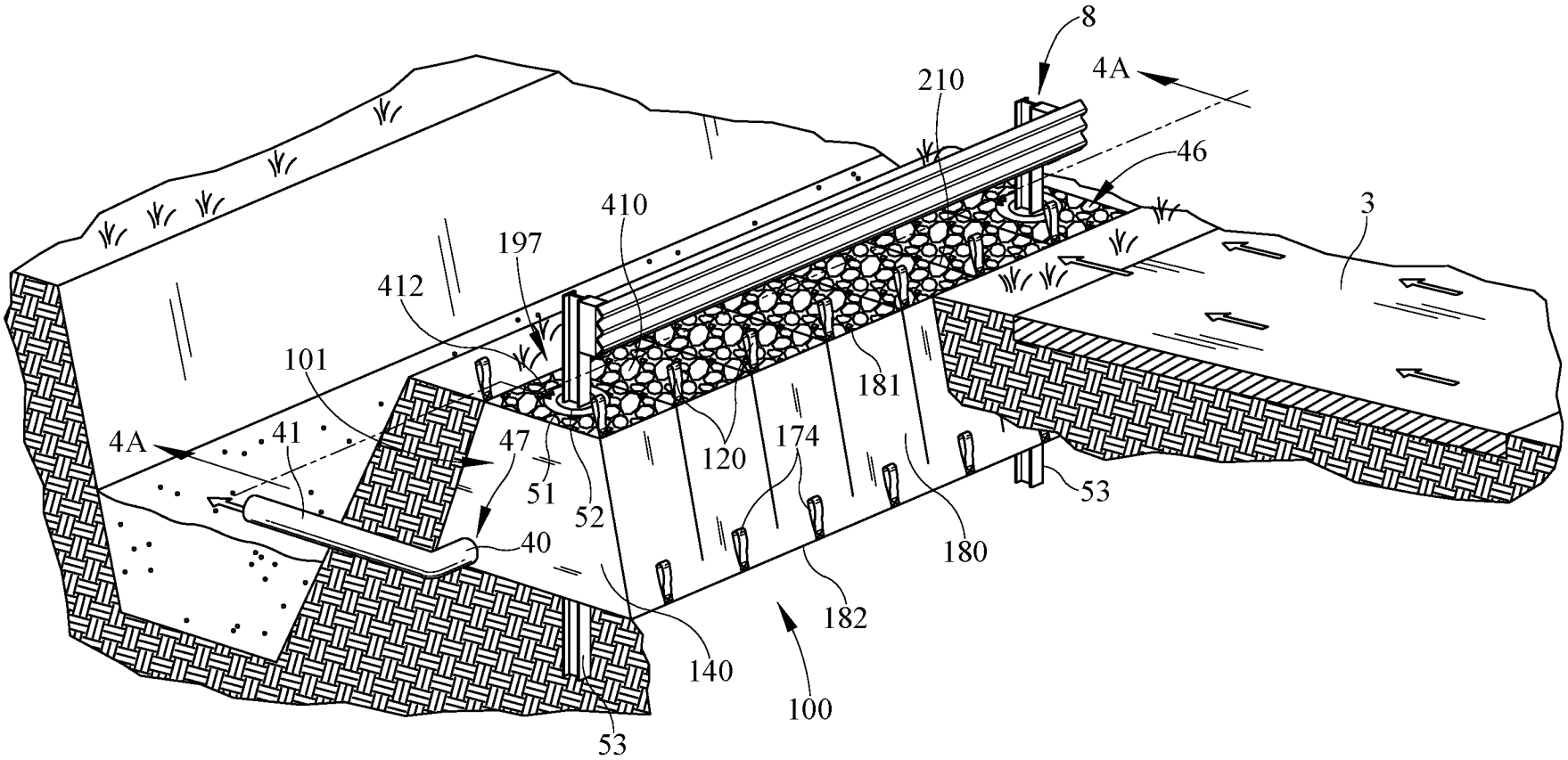
FIG. 4 is a perspective view of another embodiment of the reservoir bag of FIG. 1 without the female connection and lid structure, illustrating the bag in a partially subterranean or uncovered application with a parking lot or road, or alternatively described as its top opening being substantially flush with or adjacent the ground level, this one embodiment is also shown with a guard rail incorporated therewith.
Figure 5:
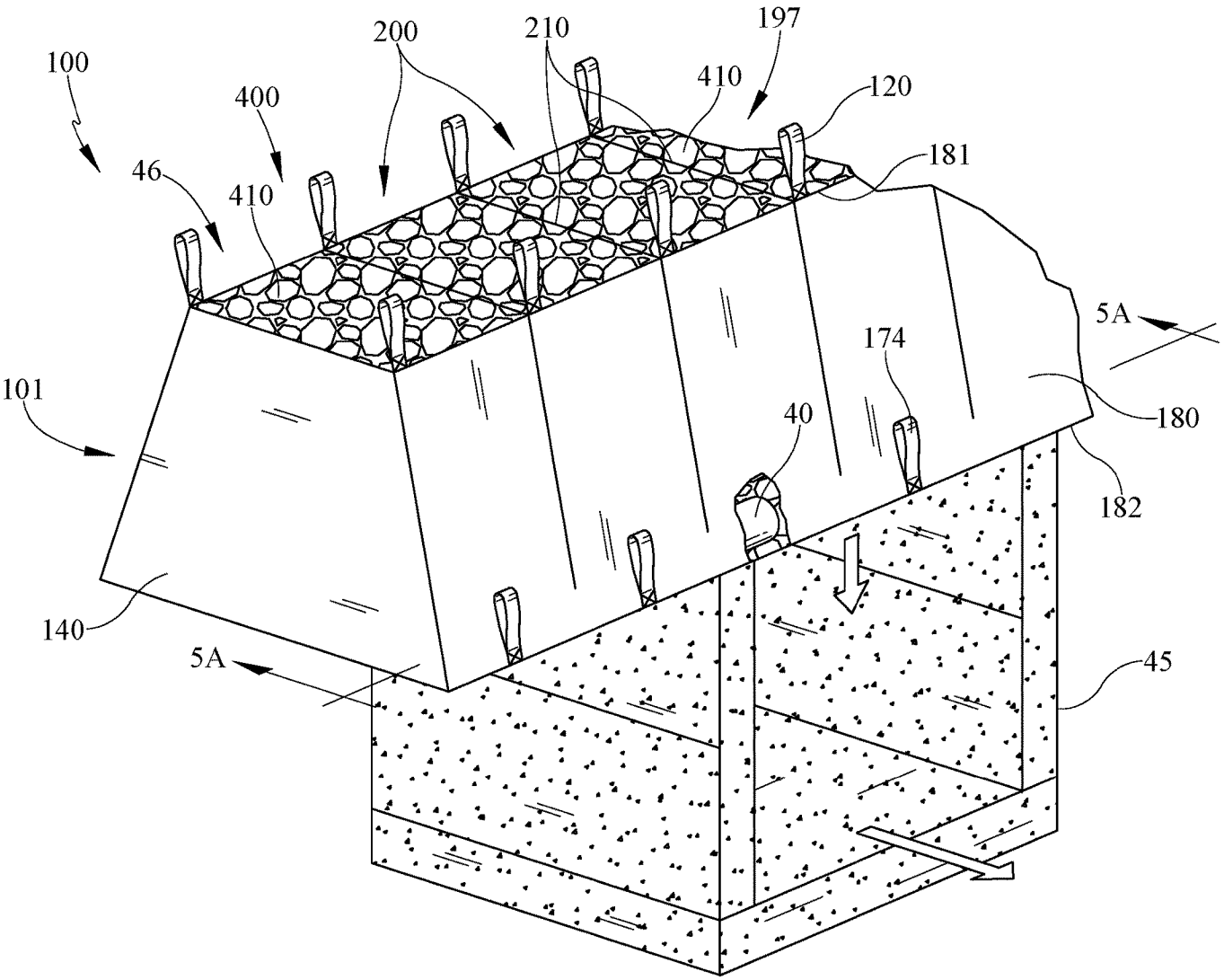
FIG. 5 is a perspective view of another embodiment of the reservoir bag of FIG. 1 without the female connection, with the lid structure broken away to illustrate the bag with opposing closed ends in fluid communication with a downstream storm sewer basin.
Figure 5A:
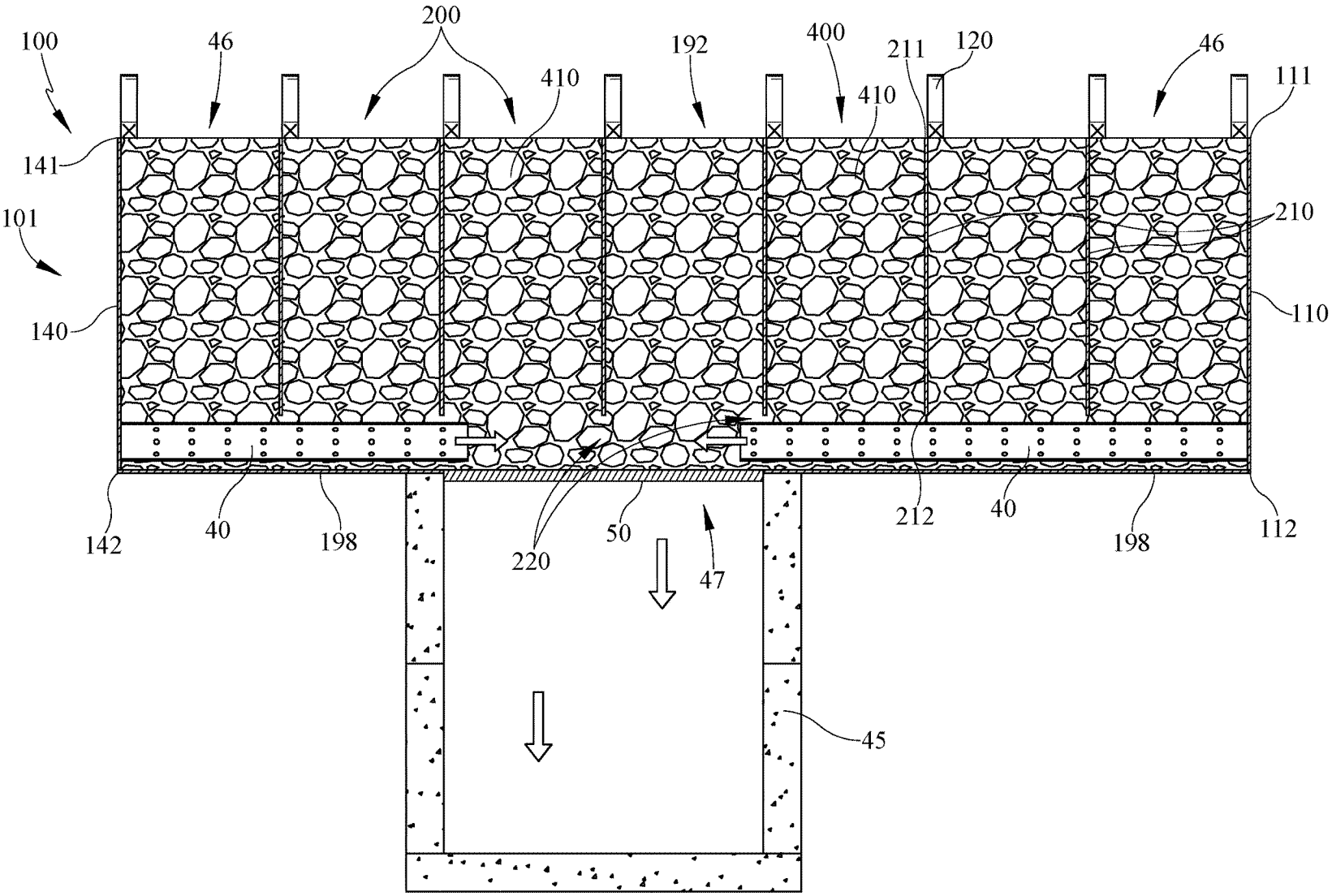
FIG. 5A is a side sectional view of FIG. 5 taken along line 5A-5A.

As shown in the Figures, one or more bags 100 may include one or more inlet or upstream openings 46 and/or one or more outlet or downstream openings 47. It should be understood that the openings, inlet and/or outlet openings 46, 47 such as external openings within the outer panels of the bag (bottom, lid, sides, and/or end panels of the bag, etc.) and/or internal openings within the bag (such as but not limited to the baffles, lid, bottom, sides, and/or end panels, etc.), may be a variety of shapes, sizes, quantities, constructions, and positions within the bag and still provide desired flow characteristics of water therethrough. The top opening 197 of the bag 100 may include or define one or more openings, outlet and/or inlet 47, 46, therein. For example as shown in FIG. 1, the top opening 197 of the bag 100 may be open or closed if a lid 190, or portions thereof, are included to become an outlet and/or inlet opening 47, 46. For example the embodiment as shown in FIG. 4, the top opening 197 of the bag 100 at surface level is the inlet opening 46 receiving water runoff of the impervious ground surface since the bag lacks a lid 190 or has a partial lid covering the top opening. As shown in the embodiment of FIGS. 3 and 3A, the lid 190 includes an inlet opening 46 downstream of the surface grate 50. As shown in the embodiment in FIG. 7, the lid 190 includes an outlet opening 47 for water to be pump out of the bag 100. Further, the first end panel 110 and/or second end panel 140 may be closed or have one or more openings. If the end panels 110, 140 include one or more openings therein, the one or more openings in the end panels may be inlet or upstream openings 46 and/or outlet or downstream openings 47 depending on the particular application. As shown in FIGS. 1-3A, the second end panel 140 includes an outlet opening 47, similar to the baffle through openings 220, a bottom edge 145 of the end panel 140 is spaced away from the bottom panel 198 and extends at least partially from one side panel 180 to the other side panel 170. As shown in FIG. 3, the outlet opening 47 may be partially filled by concrete 412 and surround the perforated pipes 40 extending therethrough thereby allowing water to flow through the pipes instead of the concrete filled opening. Although not shown, one or more cells or one or more bags 100 may have included aggregate around the perforated pipe 40 at the inlet and/or outlet openings. Further as shown in the embodiment of FIG. 4, the second end panel 140 includes a circular outlet opening 47 receiving the perforated pipe 40 adjacent the bottom panel 198. As shown in the embodiments of FIGS. 5 and 7, the second end panel 140 is closed. The opposing first end panel 110 may be closed (FIG. 3A-5A) or include an inlet and/or outlet opening (FIGS. 1A, 6 and 7) with or without an opening the same or dissimilar to the other end panel. For instance as shown in the embodiment of FIG. 1A, one end panel 140 may have an outlet opening 47 and the other end panel 110 may have an inlet opening 46. The inlet opening 46 of one bag 100 may be connected to another bag's outlet 47, with or without a perforated pipe 40, or a storm sewer basin 45 etc. For example, the storm sewer basin 45 may be upstream or downstream of the bag 100 depending on the application. Further in some embodiment, the bottom panel 198 of the reservoir bag 100 may include an inlet and/or outlet opening. As shown in the embodiment of FIGS. 5 and 5A, the bottom panel 198 may have at least an outlet opening 47 with a grate 50 whereby water flows down into a concrete storm sewer basin 45. Although not shown, one or more of the sides 170, 180 may include an inlet and/or outlet opening.

It should be understood that one or more internal and exterior openings of the reservoir bag 100 may be predetermined and created at the time of manufacture, or may be created by a user upon the desired application. For instance, a bag 100 may be manufactured with a closed end as shown in FIG. 5, but when the application needs an outlet opening in the first end panel 110 it can be cut to size about the desired pipe or structure. For example, if connecting two bags 100 together to increase their combined length, or increase retention volume, the openings 46 and 47 adjacent the adjoining end panels 110 and 140 at the male and female connection or receiving cell 300, if included, may be cut to size if not already present to allow the flow of water between bags. Further for example an outlet opening 47 in the bottom panel 198 can be cut out to communicate with a grate 50 if not already present in the bottom panel 198 at the time of manufacture, see FIG. 5A. Further, one or more lids 190 can be subsequently attached or removed depending on the application of the bag 100.

Lid 190 may include one or more lid end straps or attachments 191*a*, 191*b* and/or one or more lid side straps or attachments 191*c*, which may be used to attach, removably or otherwise, lid 190 to first end panel 110, second end panel 140, and/or second side panel 180 in order to secure the lid 190 relative to the elongated body 101 in a closed position. Any or all lid straps 191*a*, 191*b*, 191*c*, if included, may include mating or attachment portions 195*a*, 195*b*, 195*c* that may be, but is not limited to, hook and loop fasteners. These attachment portions 195*a*, 195*b*, and 195*c* may be removably attachable to corresponding respective mating or attachment portions 130, 160, 174 located on first end panel 110, second end panel 140, and second side panel 180, respectively. More specifically, one embodiment illustrates the end lid attachment portions 130, 160 and side lid attachment portions 174 are shown as, but are not limited to, loops. In use, the straps 191*a*, 191*b*, and 191*c* are inserted through their respective loops of the attachment portions 130, 160, and 174, overlapped upon themselves to tighten the lid 190 to the elongated body 101 to enclose the material 400, and subsequently secured in their overlapping engagement by their respective hook and loop fasteners 195*a*, 195*b*, and 195*c*.

Lid 190 may be attached to, connected to, and/or included with reservoir bag 100, for example, at seam 171. Seam 171 may act as a hinge to allow swinging motion of lid 190 relative to first side panel 170 and thereby allow opening and closing of the tops of any or all loading cells 200 or the internal space of reservoir bag 100. In this way, enclosure of the interior space or loading cell(s) 200 may be achieved in combination with any or all of bottom panel 198, side panels 170, 180, baffles 210 and/or 214, and end panels 110, 140. Once any or all loading cells 200 or the interior space has been filled with fill material 400 as desired (if desired), lid 190 may be closed to substantially enclose material 400 and/or top of the internal space or loading cell(s) 200. Closure of lid 190 may, for example, aid in retaining fill material 400 within the internal space or loading cell(s) 200 and/or may improve the ability of one reservoir bag 100 to be at least partially buried beneath the ground or other structure.

In some embodiments, one or more handles or loops 120 may be included to, for example, facilitate lifting, filling the bags, and/or moving reservoir bag(s) 100. If included, handles 120 may be attached to, connected to, and/or included with end panels 110, 140, side panels 170, 180, and/or may extend above respective side panel top edges 171, 181. It is understood that any number of handles 120 may be included and may be located at virtually any location or locations on reservoir bag 100. As is shown in one embodiment of FIGS. 1 and 1A, handles 120 may be attached to side panels 170, 180 adjacent the bottom panel 198 that may be attached to, connected to, or included, by any of a variety of methods, including, but not limited to, sewing, stitching, welding, adhering, bonding, or any other method of connection or attachment, or any combination thereof. Although not shown, handles 120 may be attached to the exterior of the sides 170, 180 adjacent the baffles 210, or seams 173, 183, connection for example to expand the bag to aid in filling the bag.

One embodiment to facilitate fluidly interlocking, linking, or chaining of multiple reservoir bags 100, whether it be two or more, reservoir bag 100 may include a receiving cell 300. Alternatively, bag 100 may be spaced from each other and still fluidly connected by a variety of structures including but not limited to conduit. Receiving cell 300 may be attached to any or all of second end panel 140, first side panel 170, and second side panel 180, and/or may extend longitudinally outwardly therefrom so as to create a space that may receive and/or support first end panel 110 (and/or some or all of first side 170, second side 180, and/or a bottom or bottom panel 198) therein. To aid in receiving first end panel 110 (and/or some or all of first side 170, second side 180, and/or bottom or bottom panel 198), receiving cell 300 may be open-ended opposite second end panel 140 and/or at the top (for example, opposite a bottom extension panel 330, if it is included). Receiving panel may be sized, shaped, and/or configured similarly to first end panel 110 for any of a variety of reasons, including, but not limited to, facilitating a strong or solid reception and/or attachment of two or more reservoir bags 100 and/or enhancing the ability of linked reservoir bags 100 to fluidly connect. Although the receiving cell 300 allows for the interlocking of two or more reservoir bags 100 in a longitudinal direction, it is understood that the receiving cell may additionally or alternatively link reservoir bags in a transverse direction to the longitudinal direction.

Receiving cell 300 may include any or all of bottom extension panel 330, a first extension panel 310, and a second extension panel 320. If included, bottom extension panel 330 may be attached to second end panel 140 and/or bottom panel 198, for example, at seam 142, and/or may extend longitudinally outwardly from second end panel 140 to a terminal end 331. First extension panel 310 may be attached to second end panel 140 and/or first side panel 170 at seam 143, and/or may be attached to bottom extension panel 330 at seam 312, and/or may extend longitudinally outwardly to a terminal end 313. First extension panel 310 may have a top edge 311. Second extension panel 320 may be attached to second end panel 140 and/or second side panel 180 at seam 144, and/or may be attached to bottom extension panel 330 at seam 322, and/or may extend longitudinally outwardly to a terminal end 323. Second extension panel 320 may have a top edge 321. In this way, receiving cell 300 may be attached to reservoir bag 100 (or the remainder of reservoir bag 100, as receiving cell 300 may be considered a part of, and not an addition to, reservoir bag 100) adjacent the second end panel 140.

It is understood that receiving cell 300 may be formed without any or all of bottom extension panel 330, first side or first extension panel 310, and/or second side or second extension panel 320, and other alternatives of forming a functional receiving cell will be readily understood. For example, in some embodiments, receiving cell 300 may be formed by first extension panel 310 and second extension panel 320 without inclusion of bottom extension panel 330. Any or all seams referred to herein may be used to indicate a location where two or more features are connected or intersect. It is understood that any or all seams referred to herein may be formed by any of a variety of methods, including, but not limited to, sewing, stitching, welding, adhering, bonding, or any other method of connection or attachment, and/or any or all seams referred to herein may refer to an intersection point of integral features (e.g., features that form or are formed as a unit and/or have no clear physical separation). In some embodiments, any or all seams may be stitched or sewn to provide sufficient strength and water sealing characteristics. In embodiments including at least some construction from fabric, reservoir bag 100 may include stitched or sewn seams as a convenient method of attaching the fabric components.

Reservoir bag 100 may be removably attachable and/or fluidly connected to another reservoir bag 100. For example, a second reservoir bag 100 may be partially inserted into receiving cell 300 of a first reservoir bag 100. The first and second reservoir bags 100 may then be removably attached, connected, and/or secured together. For example, in some embodiments reservoir bag 100 may include one or more attachments or extension straps 340, 350 extending longitudinally beyond terminal end 331, terminal end 313, and/or terminal end 323, if included. In this way, when extended outwardly, and a second reservoir bag 100 is partially or fully inserted into a first reservoir bag 100, any or all extension straps 340, 350 may be made to overlap a portion of first side panel 170 and/or second side panel 180. Extension straps 340, 350 may include first mating or attachment portions 345, 355 that may be, but is not limited to, hook and loop fasteners. These attachment portions 345 and 355 of a first reservoir bag 100 may removably mate or attach to respective second mating or attachment portions 175, 184, respectively, of a second reservoir bag 100. The attachment portions 175 and 184 are shown as, but is not limited to, D-rings or loops. Although second attachment portion 184 is shown more clearly in FIG. 9, it may be substantially similar to second attachment portion 175 (not shown), but located on the outside surface of first side panel 170 instead of on second side panel 180. In this way, a first reservoir bag 100 may be removably attached to a second reservoir bag 100 that is at least partially inserted in receiving cell 300 of the first reservoir bag 100. In use, the straps 340 and 350 are inserted into their respective D-ring of the attachment portions 175 and 184, overlapped upon themselves to longitudinally tighten the first reservoir bag 100 to the second reservoir bag 100 that is inserted in the receiving cell 300 of the first reservoir bag, and subsequently secured in their overlapping engagement by their respective hook and loop fasteners 345 and 355. Further, inside attachments or loops 342 extending from the second end panel 140 of a first reservoir bag 100 may be used to receive or mate with the attachments or respective attachment portions or straps 186, respectively, of a second reservoir bag 100. In use, the straps 186 are inserted into their respective loops 342, overlapped upon themselves to longitudinally tighten the first reservoir bag 100 to the second reservoir bag 100 that is inserted in the receiving cell 300 of the first reservoir bag, and subsequently secured in their overlapping engagement by their respective hook and loop fasteners. Once two bags 100 are longitudinally attached to another, the respective inlet and outlet openings 46, 47 of the respective upstream and downstream bags may be in fluid communication with each other as well as but not limited to perforated pipes 40 if used.

In some embodiments, removable attachments may alternatively be achieved by use of hook-and-loop fasteners split between the straps 340, 350 and the attachment portions 175, 184, instead of being located together on the straps 340 and 350. It is understood that the attachments shown are merely one example of a type of attachment mechanism that may be used and any of a variety of other attachment mechanisms may be used instead of, or in addition to, hook-and-loop style fasteners. For example, first attachment portions 345, 355 may be straps that are tied to respective second attachment portions 175, 184, which in turn may also be straps or loops for tying to first attachment portions 345, 355. In some embodiments, any or all of first attachment portions 345, 355, 186 and/or second attachment portions 175, 184, 342 may include mechanical snaps, screws, bolts, nails, bolts, nuts, adhesives, tongue-and-groove style fasteners, belts (e.g., belt and D-ring style fasteners), tie offs, or any other attachment mechanism, or any combination thereof. It is understood that these are merely examples and that any type of attachment mechanism may be used to releasably or fixedly secure the first reservoir bag 100 to one or more additional reservoir bags 100.

As mentioned above, with respect to first attachment portions 345, 355 and/or second attachment portions 175, 184, in some embodiments, any or all attachment portions 195*a*, 195*b*, 195*c*, 130, 160, 174 may include hook-and-loop style fastener portions that are separated on either the strap and loop, mechanical snaps, screws, bolts, nails, bolts, nuts, adhesives, tongue-and-groove style fasteners, belts (e.g., belt and D-ring style fasteners), tie offs, or any other attachment mechanism, or any combination thereof. It is understood that these are merely examples and that any type of attachment mechanism may be used to releasably or fixedly secure the lid 190 to the body 101.

As shown in FIGS. 1-1A and 3-5A, reservoir bag 100 and/or receiving cell 300 are shown as being substantially trapezoidal in cross-sectional shape substantially perpendicular to the longitudinal direction of reservoir bag 100. Although shown as having a substantially trapezoidal cross-sectional shape, it is understood that reservoir bag 100 and/or receiving cell 300 may be any of a variety of shapes, including, but not limited to, rectangular, square, triangular, polygonal, ovular, round, circular, or any other shape, or any combination thereof. For example another embodiment as illustrated in FIG. 2 includes a cross-sectional shape that may be, but is not limited to, a rectangular shape. It is further understood that, although receiving cell 300 is depicted as having substantially the same cross-sectional shape as reservoir bag 100 (or the remainder thereof), receiving cell 300 may, in some embodiments, be shaped independently of reservoir bag 100 (or the remainder thereof). Further still, it is understood that, although reservoir bag 100 and receiving cell 300 are each shown having a substantially uniform cross-sectional shape, no such uniformity is required and either or both of reservoir bag 100 and receiving cell 300 may have varying cross-sectional shapes.

Estimated Volume of Water Storage

One estimate of the volume of water than can be temporarily stored is shown below in the chart for reservoir bags 100 that have a rectangular and/or square in cross-section at 2'×2', 3'×3', 3'×4', and 4'×6' in width W and height H, respectively. The calculations in the chart below are given for each 100 linear foot of bag. Each bag is assumed to be filled with an aggregate which has roughly 53.5% voids. One cubic foot of water is equivalent to 7.481 gallons of water. The calculations below are depicted below for each size. It is understood that changes in dimensions, aggregate void, and/or quantity of bags etc. may change the calculated storage of a reservoir bag for a desired application and these calculations. Further, changes in dimensions, aggregate void, one or more perforated pipes, inlet and outlets, and/or other structure upstream, downstream, and/or within the bag may also change the flow characteristics of the water entering, leaving, and traveling through the bag. Flow characteristics may include, but is not limited to, speed of water flow within, entering, and/or leaving the bag 100.

| SIZE (W × H × L) | VOLUME OF EMPTY BAG, CF | PERCENTAGE OF VOIDS, % | VOLUME OF WATER CF | VOLUME OF WATER, GALLONS |
|---|---|---|---|---|
| 2' × 2' × 100' | 400 | 53.5 | 214 | 1,600.93 |
| 3' × 3' × 100' | 900 | 53.5 | 481.5 | 3,602.10 |
| 3' × 4' × 100' | 1,200 | 53.5 | 642 | 4,802.80 |
| 4' × 6' × 100' | 2,400 | 53.5 | 1,284 | 9,605.60 |

Embodiments of Reservoir Bag Applications

In use, one or more reservoir bags may be sized and shaped for a particular application of the volume of water that can be stored. Two or more bags may also be fluidly connected for an application. The aggregate size may also be chosen to facilitate the percentage of voids and the flow characteristic of the water entering, traveling through, and/or leaving the bag. The bag may loaded with one or more perforated pipes if needed and subsequently filled with the aggregate or additional material, such as but not limited to concrete. One or more cells may have one or more of the materials loaded therein such as concrete and aggregate, concrete by itself, and/or aggregate by itself. Alternatively, one or more cells could be partially and/or substantially void of material. The diameter of the perforated pipe and quantity of pipes may also be chosen for the desired flow volume of water. An overflow may be constructed, for example from one or more perforated pipes spaced away from the bottom of the bag at one or more desired levels. The bag may be loaded in its final position or alternatively be loaded and moved to a location. Additional structure such as but limited to one or more grates, pumps, storm outlet and inlet pipes, concrete storm sewer basins and/or head walls, guard rails, cable barriers, and floats may be included at least partially within the bag or in flow communication with the bag, upstream and/or downstream. If a lid is used, the lid can be closed upon the fillable openings to enclose the plurality of cells. The top opening of the elongated body may be adjacent the ground level after placement within the ground. Alternatively, the bag may be positioned within the ground or subterranean such that the bag is covered or at least partially covered. Further if a pump and/or float is used, the water collected can be pumped out of the elongated body of the bag at a desired level of water or time. In addition, one or more inlet openings, outlet openings, and/or internal openings can be added at desired locations of the bag if not present at the time of manufacture. Alternatively, inlet and/or outlet openings can be closed off such as being sewn shut or closed off by material within the bag. Backfill can be placed about the periphery or portions thereof of the bag upon placement. The inlet and/or outlet openings of the bag or portions of the bag may be fluidly connected to additional structure upstream and downstream of the bag to facilitate the flow of water entering and leaving the bag.

In use, one embodiment is shown in FIGS. 3 and 3A. The reservoir bag 100 is positioned within a trench within the ground, the bottom of the trench may include a grade to allow water to flow along the bottom panel 198 to the outlet opening 47. The bag 100 contours to the ground grade or angle to allow water to flow by gravity through the bag. The grade may be, but is not limited to, between 0.5 degrees to about 5 degrees. In it is understood the bag may contour to one or more grades to direct water flow. The outlet opening 47 may have been cut open or existed already in the bag 100. The collapsed bag is opened and one or more perforated pipes 40 are laid longitudinally within the through openings 220 of the baffle 210. One or more handles 120 may assist in holding the bag open to fill material 400. A predetermined aggregate 410 is laid around the perforated pipe 40. As is shown in this embodiment, concrete 412 is poured in the cells 200 at the opposing ends of the body 101. The concrete 412, at least at the outlet end of the bag 100, surrounds the pipe 40 and closes the outlet opening 47 such that the water flows out the perforated pipe 40. As illustrated one or more cells 200 may also have concrete 412 poured upon a layer of aggregate 410. This allows for water to continue to flow through the aggregate 410, under the baffle bottom edge 212, and/or length L of the bag. With the material 400 filled into one or more cells 200, the lid 190 may be closed and attached via straps 191*a*, 191*b*, and 191*c* as described above. If inlet opening 46 is not already present, an inlet opening 46 can be cut into the lid 190 and a conduit or other structure may positioned to engage the surface grate 50. With the lid 190 closed, the back fill of dirt can be position around the outer periphery of the bag. A road, parking lot 2, or other impervious structure may be laid above the back fill. A surface opening is positioned in fluid communication with the inlet opening 46 of the bag 100. In the embodiment shown, a grate 50 is used adjacent the parking lot 2 surface. The perforated pipes 40 may also be tied to a downstream sewer pipe, concrete headwall, or basin if desired. Further, the bag may be in fluid communication with upstream and/or downstream structures such as but not limited to sewers, additional bags, etc. It should be understood, that one or more surface openings may be in fluid communication with one or more bags 100. Also, although not shown an additional bag 100 may be in fluid communication with or used along with the bag as shown. Although not shown, an overflow pipe 40 may be included.

Figure 4A:
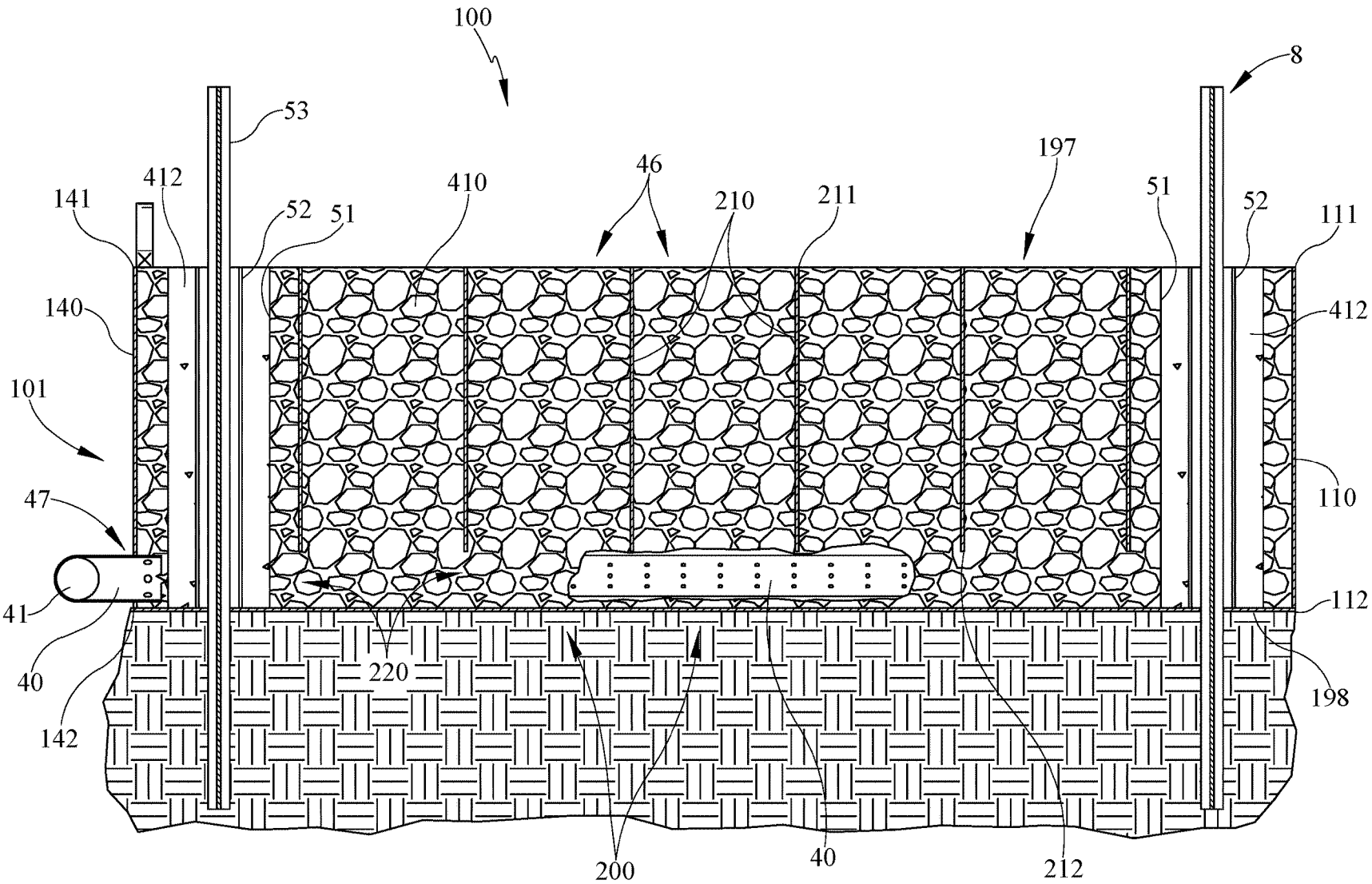
FIG. 4A is a side sectional view of FIG. 4 taken along line 4A-4A.

In use, another embodiment is shown in FIGS. 4 and 4A. The reservoir bag 100 is positioned along a roadway 3. The bag 100 collects and transports roadway runoff to a desired discharge location alleviating problematic scouring along the roadway bank. The bag 100 is shown with a guardrail 8, or may be cable guardrail with cables extending between barrier posts 53 (not shown) instead of the rail, however it is understood that no guardrail may be used for example in this application. The trapezoidal cross section provides structural support of the roadway 3 by resisting both sliding and rotational forces exerted on the bag 100 by the adjoining traffic. The bag 100 can be positioned in a graded trench. If used, one or more 18" manufactured piers 51 and an interiorly spaced 3" sleeve 52 may be vertically positioned in one or more cells 200 adjacent the bottom panel 198. The piers 51 may be positioned 10 foot on center. The outlet opening 47 may have been cut open or existed already in the bag 100 in the second end panel 140. The collapsed bag 100 is opened and one or more perforated pipes 40, if used, are laid or installed longitudinally within the through openings 220 or under the bottom edge 212 of the baffle 210. One or more handles 120 may assist in holding the bag open to fill material 400. A predetermined aggregate 410 is laid around the perforated pipe 40 and the outer periphery of the piers 51. A 2" cable barrier post 53 is inserted into each one of the sleeves 52 and driven through the bottom panel 198 or through an existing opening in the bottom panel 198. Material 400, such as but not limited to concrete 412 or sand is then filled between the pier 51 and sleeve 52. As is shown in this embodiment, concrete 412 is poured in the cells 200 at the opposing ends of the body 101. Once backfilled about the outer periphery of the bag 100 leaving all or part of the top opening 197 open, the roadway 3 or impervious structure may be installed. It is understood, that the bag 100 may be installed after a roadway 3 or adjacent an existing structure. The one or more perforated pipes 40 can also be connected to a downstream and/or upstream conduit, ditch, drain, storm water basin, bag 100 and/or stream channel. Alternative, if a guardrail 8 is not installed one application of the bag 100 may occur within a ditch along the toe of a high wall or hillside. This installation collects and transports runoff to a desired discharge location alleviating problematic ponding and poor drainage as well as provides structural support of any adjoining developed site reducing site damage due to settlement.

In use, another embodiment is shown in FIGS. 5 and 5A. In this application embodiment, a reservoir bag 100 with closed end panels 140 and 110 is integrated with a concrete storm sewer basin 45. The bag 100 can be positioned in a dual graded trench with the bottom surfaces angled downwardly towards a top opening of a concrete storm sewer basin 45. The top opening 197 of the bag 100 may be the inlet opening 46, however other inlet positions should be considered. The collapsed bag 100 is opened and one or more perforated pipes 40, if used, are laid longitudinally within the through openings 220 of the baffle 210. At least one pipe 40 extends from the second end panel 140 to the storm sewer basin 45 and the other side having at least one pipe 40 extends from the first end panel 110 to the storm sewer basin 45. The outlet opening 47 may have been cut open or existed already in the bag 100 in the bottom panel 198. For example, the grate 50 may be placed horizontally into the bag at the bottom panel 198 and the outlet opening cut to size. One or more handles 120 may assist in holding the bag open to fill material 400, shown as aggregate 410. A predetermined aggregate 410 is laid around the perforated pipe 40. Once backfilled about the outer periphery of the bag 100 leaving all or part of the top opening 197 open adjacent the surface, the roadway or impervious structure may be installed. Alternatively, a lid 190 may be used and the lid 190 fully or partially covered. It is understood, that the bag 100 may be installed with an existing roadway or adjacent other existing structure. The perforated pipe 40 can also be connected to an upstream and/or downstream conduit, ditch, drain, storm water basin, bag 100, and/or stream channel.

In use, another embodiment is shown in FIG. 6. In this application embodiment, a reservoir bag 100 may be integrated with a downstream concrete headwall 54, vertical grate 50, storm outlet pipe 41, and/or one or more overflow pipes 40. The reservoir bag 100 is installed upstream of a headwall 54 with an interconnecting conduit 41 extending through second end panel 140 with an outlet opening 47. A vertical grate is placed at the inlet to the conduit 41 within the bag cell 200. Further, a perforated pipe 40 is placed at a level or height within the bag to overflow water at a predetermined volume. The pipe 40 extends through the through opening 220*a* of the baffles 210. The bag 100 is filled with material 400. The cell 200 adjacent the second end panel is filled with concrete that surrounds the storm outlet pipe 41, while the remaining cells received the aggregate 410 allowing water to flow adjacent the bottom panel 198, under the bottom edge 212, and/or through the through openings 220 to the grate 50, as well as enter the overflow perforated pipe 40 if the level of water exceeds a predetermined level or volume. Although not shown, it is understood that pipes 40 may be included longitudinal within through openings 220. Again, closing the lid 190, if used, may occur before back fill covers the bag 100. This application allows for the bag 100 to drain at a particular flow rate through the aggregate 410 underneath the baffles 210, through the through openings 220, and exit the system. However if there is too much water entering the system, the overflow pipes 40 will alleviate any excess water when it reaches the level of the pipe. The overflow pipe 40 may reduce the ponding or backup of water upstream of the bag 100.

In use, another embodiment is shown in FIG. 7. In this application embodiment, a reservoir bag 100 may be integrated with a substantially open cell 200*a* with a pump 6 and/or float. An overflow pipe 40 may be used as well. The open cell 200*a* is adjacent the concrete filled cell 200 that is adjacent the second end panel 140. The open cell 200*a* includes the pump 6 with float discharging through a conduit 7 through the outlet opening 47 of the lid 190. When the water level rises to a level within the open cell 200*a*, the pump 6 will discharge or pump out the volume of water. If the water level within the cells 200 upstream of the pump 6 reach the overflow pipe 40, if used, overflow water will be added more quickly to the open cell thus increasing the frequency of the pump 6 to expel water from the system. This delay of expelling water from the system may alleviate downstream water levels or when the capacity of downstream sewers are maxed out during a flash flood, thus releasing water at a later time when the downstream water levels subside. Although a perforated pipe 40 is not shown positioned within the through openings 220 fluidly connecting the cells, additional pipes 40 may be included.

While several embodiments have been described and illustrated herein, those of ordinary skill in the art will readily envision a variety of other means and/or structures for performing the function and/or obtaining the results and/or one or more of the advantages described herein, and each of such variations and/or modifications is deemed to be within the scope of the embodiments described herein. More generally, those skilled in the art will readily appreciate that all parameters, dimensions, materials, and configurations described herein are meant to be exemplary and that the actual parameters, dimensions, materials, and/or configurations will depend upon the specific application or applications for which the teachings is/are used. Those skilled in the art will recognize, or be able to ascertain using no more than routine experimentation, many equivalents to the specific embodiments described herein. It is, therefore, to be understood that the foregoing embodiments are presented by way of example only and that, within the scope of the appended claims and equivalents thereto, embodiments may be practiced otherwise than as specifically described and claimed. Embodiments of the present disclosure are directed to each individual feature, system, article, material, kit, and/or method described herein. In addition, any combination of two or more such features, systems, articles, materials, kits, and/or methods, if such features, systems, articles, materials, kits, and/or methods are not mutually inconsistent, is included within the scope of the present disclosure.

All definitions, as defined and used herein, should be understood to control over dictionary definitions, definitions in documents incorporated by reference, and/or ordinary meanings of the defined terms. The indefinite articles "a" and "an," as used herein in the specification and in the claims, unless clearly indicated to the contrary, should be understood to mean "at least one." The phrase "and/or," as used herein in the specification and in the claims, should be understood to mean "either or both" of the elements so conjoined, i.e., elements that are conjunctively present in some cases and disjunctively present in other cases.

Multiple elements listed with "and/or" should be construed in the same fashion, i.e., "one or more" of the elements so conjoined. Other elements may optionally be present other than the elements specifically identified by the "and/or" clause, whether related or unrelated to those elements specifically identified. Thus, as a non-limiting example, a reference to "A and/or B", when used in conjunction with open-ended language such as "comprising" can refer, in one embodiment, to A only (optionally including elements other than B); in another embodiment, to B only (optionally including elements other than A); in yet another embodiment, to both A and B (optionally including other elements); etc.

As used herein in the specification and in the claims, "or" should be understood to have the same meaning as "and/or" as defined above. For example, when separating items in a list, "or" or "and/or" shall be interpreted as being inclusive, i.e., the inclusion of at least one, but also including more than one, of a number or list of elements, and, optionally, additional unlisted items. Only terms clearly indicated to the contrary, such as "only one of" or "exactly one of," or, when used in the claims, "consisting of," will refer to the inclusion of exactly one element of a number or list of elements. In general, the term "or" as used herein shall only be interpreted as indicating exclusive alternatives (i.e. "one or the other but not both") when preceded by terms of exclusivity, such as "either," "one of," "only one of" or "exactly one of" "Consisting essentially of," when used in the claims, shall have its ordinary meaning as used in the field of patent law.

As used herein in the specification and in the claims, the phrase "at least one," in reference to a list of one or more elements, should be understood to mean at least one element selected from any one or more of the elements in the list of elements, but not necessarily including at least one of each and every element specifically listed within the list of elements and not excluding any combinations of elements in the list of elements. This definition also allows that elements may optionally be present other than the elements specifically identified within the list of elements to which the phrase "at least one" refers, whether related or unrelated to those elements specifically identified. Thus, as a non-limiting example, "at least one of A and B" (or, equivalently, "at least one of A or B," or, equivalently "at least one of A and/or B") can refer, in one embodiment, to at least one, optionally including more than one, A, with no B present (and optionally including elements other than B); in another embodiment, to at least one, optionally including more than one, B, with no A present (and optionally including elements other than A); in yet another embodiment, to at least one, optionally including more than one, A, and at least one, optionally including more than one, B (and optionally including other elements); etc.

It should also be understood that, unless clearly indicated to the contrary, in any methods claimed herein that include more than one step or act, the order of the steps or acts of the method is not necessarily limited to the order in which the steps or acts of the method are recited.

In the claims, as well as in the specification above, all transitional phrases such as "comprising," "including," "carrying," "having," "containing," "involving," "holding," "composed of," and the like are to be understood to be open-ended, i.e., to mean including but not limited to. Only the transitional phrases "consisting of" and "consisting essentially of" shall be closed or semi-closed transitional phrases, respectively, as set forth in the United States Patent Office Manual of Patent Examining Procedures, Section 2111.03.

The foregoing description of several methods and embodiments have been presented for purposes of illustration. It is not intended to be exhaustive or to limit the precise steps and/or forms disclosed, and obviously many modifications and variations are possible in light of the above teaching. It is intended that the scope and all equivalents be defined by the claims appended hereto.

What is claimed is:

1. A reservoir bag, comprising:

an elongated bag including a bottom panel and opposing side panels longitudinally extending between a first end and opposing second end to define a interior volume capable of retaining at least aggregate and fluid;

a plurality of baffles extending at least between said opposing side panels to define a plurality of cells between said first end and said second end;

each of said plurality of baffles include a top edge and an opposing bottom edge, wherein said bottom edge is not substantially adjacent to said bottom panel; and at least one fluid channel extending from at least one of said plurality of cells to at least one another at least one of said plurality of cells between said baffle bottom edge and said bottom panel.

2. The reservoir bag of claim 1 wherein said elongated bag further includes an inlet opening and an outlet opening.

3. The reservoir bag of claim 2 wherein said outlet opening is in said first end or said bottom panel.

4. The reservoir bag of claim 1 wherein said fluid channel is a perforated pipe and the reservoir bag further comprising an overflow pipe.

5. The reservoir bag of claim 1 wherein said bottom edge is about 6 inches from said bottom panel.

6. The reservoir bag of claim 1 wherein said bag includes one or more grates.

7. The reservoir bag of claim 1 further comprising a through opening above said bottom edge.

8. The reservoir bag of claim 1 further including a second baffle extending longitudinally within said bag between said first end and said at least one of said baffles.

9. The reservoir bag of claim 1 further including a pump.

10. A reservoir bag comprising:

an elongated bag including a top opening, a bottom panel, and opposing side panels longitudinally extending between a first end and opposing second end to define a interior volume capable of retaining at least aggregate and fluid;

a plurality of baffles extending at least between said opposing side panels to define a plurality of cells between said first end and said second end;

each of said plurality of baffles extending from said top opening to a bottom edge not substantially adjacent to said bottom panel to define at least one through opening extending longitudinally to fluidly connect at least two adjacent said plurality of cells.

11. The reservoir bag of claim 10 further comprising one or more perforated pipes extending longitudinally within said bag.

12. The reservoir bag of claim 11 wherein said one or more pipes is positioned between said baffle bottom edge and said bottom panel.

13. The reservoir bag of claim 11 wherein said one or more perforated pipes is an overflow pipe.

14. The reservoir bag of claim 10 wherein said baffle includes another said at least one through opening above said at least one through opening.

15. The reservoir bag of claim 10 wherein said bottom edge is about 6 inches from said bottom panel.

16. The reservoir bag of claim 10 wherein said bag includes one or more outlet openings.

17. The reservoir bag of claim 16 wherein at least one of said one or more outlet openings is adjacent a top opening of said bag.

18. The reservoir bag of claim 16 wherein said bag includes one or more inlet openings.

19. The reservoir bag of claim 10 further comprising one or more barrier posts.

20. A method of controlling surface water runoff comprising the steps of:

providing one or more reservoir bags, each said one or more reservoir bags having an elongated body with a bottom panel, wherein said body is divided into a plurality of cells by one or more baffles positioned between a first end and a second end of said bag, wherein a bottom edge of said baffle is not substantially adjacent said bottom panel;

filling one or more said plurality of cells with at least an aggregate adapted to allow water to flow between adjacent said cells at least under said bottom edge of said baffle;

installing one or more perforated pipes longitudinally within said body; and positioning said reservoir bag at least partially in the ground.

21. The method of claim 20 further comprising the step of fluidly connecting said one or more reservoir bags upstream or downstream with another said one or more reservoir bags.

22. The method of claim 20 further comprising the step of closing a lid of said reservoir bag to enclose said plurality of cells.

23. The method of claim 20 wherein at least one of said one or more perforated pipes is spaced above said bottom edge of said baffle.

24. The method of claim 20 further comprising the step of at least partially filling at least one cell with concrete.

25. The method of claim 20 further comprising the step of fluidly connecting said reservoir bag with another said reservoir bag.

26. The method of claim 20 further comprising the step of positioning a top opening of said elongated body adjacent ground level.

27. The method of claim 20 further comprising the step of inserting one or more barrier posts in one or more of said plurality of cells.

28. The method of claim 20 further comprising the step of pumping water out of said body.

29. The method of claim 20 further comprising the step of adding an inlet opening or outlet opening to said reservoir bag.

30. The method of claim 20 further comprising the step of adding one or more grates within said reservoir bag.

* * * * *